US007728786B2

(12) United States Patent
Rodgers

(10) Patent No.: US 7,728,786 B2
(45) Date of Patent: Jun. 1, 2010

(54) EXTERNAL ANTENNA FOR RFID REMOTE INTERROGATION

(76) Inventor: James Neil Rodgers, 8853 214th Place, Langley, BC (CA) V1M 2H9

( * ) Notice: Subject to any disclaimer, the term of this patent is extended or adjusted under 35 U.S.C. 154(b) by 352 days.

(21) Appl. No.: 11/678,063

(22) Filed: Feb. 23, 2007

(65) Prior Publication Data

US 2008/0204339 A1 Aug. 28, 2008

(51) Int. Cl.
*H01Q 1/12* (2006.01)

(52) U.S. Cl. ..... 343/890; 343/891; 343/757; 343/904; 340/572.1

(58) Field of Classification Search ..... None
See application file for complete search history.

(56) References Cited

U.S. PATENT DOCUMENTS 5,774,193 A * 6/1998 Vaughan ..... 348/723
6,903,705 B2 * 6/2005 Livadiotti ..... 343/890
7,023,400 B2 * 4/2006 Hill ..... 343/874
7,133,471 B2 11/2006 Feher
7,142,120 B2 11/2006 Charych et al.
7,170,867 B2 1/2007 O'Toole et al.

OTHER PUBLICATIONS

Sung-Ho Kim, Young-Bac Ko, A Directional Antenna based Path Optimization Scheme for Wireless Ad Hoc Networks, College of Information and Communication, Ajou University, South Korea.
Linxuan Hu, David Evans, Using Directional Antennas to Prevent Wormhole Attacks, Department of Computer Science, University of Virginia, Charlottesville, VA.

* cited by examiner

*Primary Examiner*—Trinh V Dinh

(57) ABSTRACT

A system to capture a remote RFID electro magnetic interrogation of a warehouse or distribution center environment through the propitious use of an external directional antenna. The system comprises a directional external yagi antenna affixed to the exterior of the distribution center or warehouse distribution center; an electric motor attached to a boom of the external yagi antenna to enable the antenna to change direction; a directional finding equipment spliced to the circuit of the external yagi antenna, and multiple transformers, the antenna and interrogation units mounted to a ceiling of the warehouse or distribution center to modulate and reradiate signals of the remote microwave or ultra high frequency interrogation to interrogate transponders attached to articles at the articles' resonant frequency and re-radiate responses to the external yagi antenna for capture by the cellular transmission tower.

4 Claims, 2 Drawing Sheets

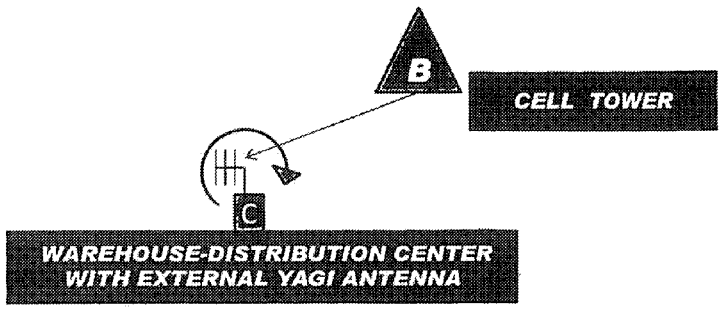

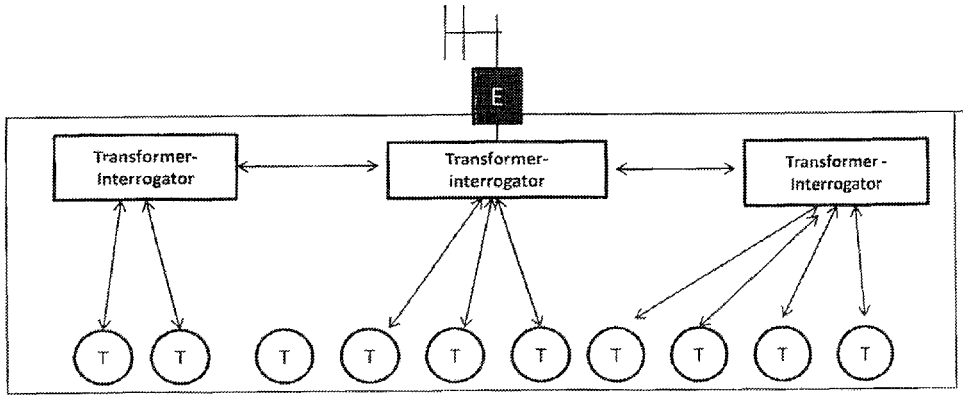

FIGURE 1A

STEP 1: REMOTE INTERROGATION STARTS
TARGET:RFID TAGGED ARTICLES

1.Arrows indicate direction of Microwave Frequency or Ultra High Frequency Interrogation Signals.
2.Circular arrow around Yagi antenna illustrates that antenna able to adjust alignment parallel to ground
3. External Yagi Antenna per 2. above Has Directional Finding Equipment And Is On Movable Motorized Boom to Enable Shift to Cell Tower Handling Current Transmission

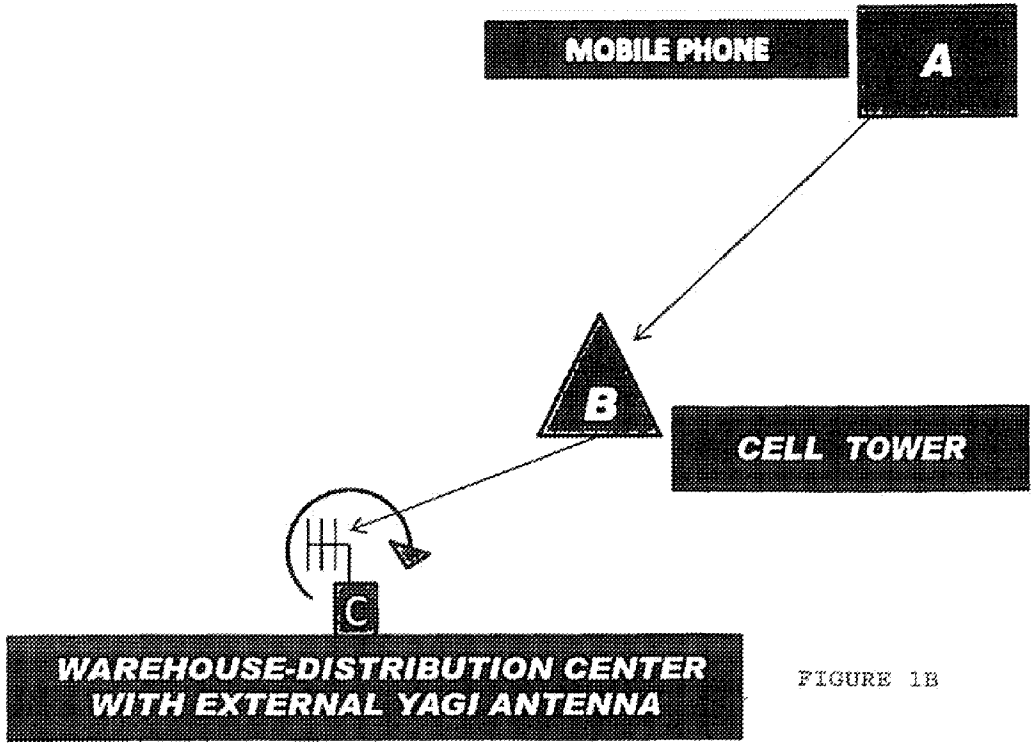

FIGURE 1B

FIGURE 2A

STEP 2 : INSIDE THE WAREHOUSE

REMOTE INTERROGATION OF TRANSPONDER TAGGED ARTICLES

1. Transformer receives microwave or ultra high frequency signal thru External Yagi Antenna (E)
2. Transformer(s) inside center convert microwave or ultra high frequency signal to RFID Transponder resonant frequency and Interrogators modulate, reradiate thru warehouse .
3. RFID Transponders (T) receive signals and identify themselves and reply to interrogation.
4. Interrogator passes reply to Transformer which converts signal frequency to microwave or ultra high frequency and sends to External Yagi Antenna through electronic connection.
5. Cell phone Transmission Tower picks up signal from External Yagi Antenna and sends to cell phone initiator.

FIGURE 2B

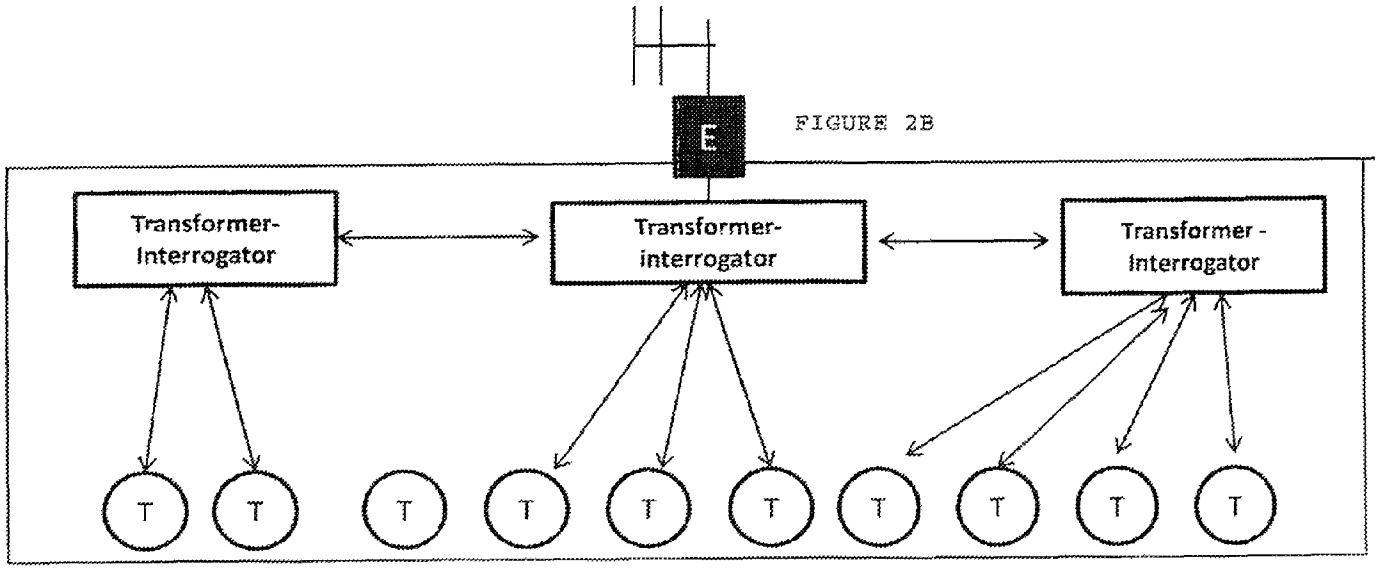

EXTERNAL ANTENNA FOR RFID REMOTE INTERROGATION

FIELD OF THE INVENTION

This invention contemplates the use of an amplifier connected to an external antenna for use in a remote inquiry RFID interrogation system located within a warehouse or distribution center environment (hereinafter the "environment").

BACKGROUND

This invention is in response to a pervasive industry wide RFID problem. Specifically, the problem is an inefficient read rate of passive RFID transponders by RFID interrogators. The inefficient read rate is due, in part, to the amount of reflection, refraction and absorption which occurs within a standard RFID interrogation environment. This problem is exacerbated, in part, by the amount of metal and liquid components located within these environments. The metals and liquids tend to reflect, refract or absorb RFID electromagnetic signal inquiries, thereby reducing read rates by increasing signal to noise interference. Furthermore, a remote electro magnetic read of the environment from a cellular telephone transmission tower, which is contemplated in this invention, is thwarted by concrete or metal on the walls or roof of the environment. This is caused by the density or physical properties of the building materials which went into the construction of the environment. Furthermore, there is significant electro magnetic attenuation of any remote RFID inquiry which is a function of the distance traveled by the remote interrogation signal.

This invention contemplates the use of a directional antenna designed to receive and transmit. The antenna is made of ceramic powder or aluminum shavings manufactured in a composite formula. The function of this invention is to increase the reading rate of an RFID interrogation system when inquiries come from a remote source. Pursuant to this invention the initial interrogation inquiry will emanate form a remote source using a microwave or ultra high frequency band. The external source contemplated is a cellular telephone transmission tower. One aspect of this invention is to channel cut the antenna or manufacture it so that it is perfectly attuned to the nearest cellular transmission tower. Alternatively, for mass produced external antennas, the boom of the antenna can be electronically swung by a remote control device so that it is pointed in the direction of the strongest electro magnetic signal emanating from a cellular telephone transmission tower. The directional antenna is located outside of the environment. For example, the directional antenna could be placed on the rooftop of the environment. The microwave electro magnetic inquiry signal will be harvested and captured by the directional antenna and then sent via a wire or wireless connection to transformer/interrogators positioned within the environment.

The concept of the invention is to use advanced composite construction materials in the outside antenna so that it efficiently receives from and transmits to a remote microwave RFID inquiry. Manufacturing components will consist of aluminum shavings and ceramic powders mixed into slurry and baked onto a Yagi antenna. The Yagi antenna is then covered in white polymer powder which is baked unto its surface to protect the reflectors and elements. It is also anodized to protect from corrosion. The antenna can be channel cut to mimic the exact wave characteristics of the initial inquiry signal or manufactured so that the antenna boom swivels 360 degrees to point in the direction of the most powerful cellular tower signal as determined by onboard commercial direction finding electronics.

This invention obviates any problems arising from signal attenuation. Attenuation is a function of distance traveled or can be caused by building material density or reflectivity. Furthermore this invention is designed to capture a weak signal from a remote inquiry if the inquiry takes place within a large cell zone. For example, for a warehouse on the outside fringes of a cellular transmission zone atmospheric conditions could play havoc with RFID remote inquiries. In other words, some remote inquiries maybe received at the environment and some not. This problem is obviated through the use of an advanced composite design of the state of the art antenna and electronic direction pointing as outlined herein. When this invention is properly manufactured and pointed it will act as an amplification device of the remote inquiry electro magnetic signal emanating from a cellular telephone transmission tower.

Once the initial RFID inquiry has been received from the cellular telephone transmission tower, the electro magnetic signal is relayed by wire (or wirelessly) to transformer/amplifier/interrogation units (hereinafter "TAINS") located within the environment. These TAINS units modulate the initial microwave inquiry. Interrogators which are attached to the transformers re-radiate the RFID inquiry into the resonant frequency of the integrated circuit passive tags which are embedded or attached to items within the environment. The TAINS units also amplify the electro magnetic signal so that it is consistently re-radiated at the maximum two watt power limitation which is the RFID industry standard. There will be enough TAINS units strategically located within the environment so that the environment is consistently blanketed with RFID interrogation signals.

It is contemplated by this invention that the outside antenna can be connected via wires or through a wireless system to a number of TAINS units. In other words, one outside antenna can service a plethora of TAINS. The TAINS contain an amplification component which ensures that the re-radiated signal is transmitted at maximum allowable power to all corners of the environment. In this way the problem of dropped RFID tag reads or misreads or double reads is obviated as there is consistent electro magnetic signal coverage within the interrogation environment.

The extraordinary sensitivity which is a product of the composite design of the outside antenna allows for better reception of the initial microwave electro magnetic signal inquiry. This sensitivity transforms the external antenna into an amplification unit of the initial cellular telephone transmission tower electro magnetic signal. Subsequently, the re-radiated electro magnetic signal emanating from the TAINS blankets the entire environment with a consistent two watt interrogation signal. The re-radiated signal is powered by wall sockets attached to the TAINS. This obviates the need for a power source on board the RFID tags. This means that the backscatter methodology can be used with one hundred percent effectiveness due to blanket and consistent interrogation from re-radiated electro magnetic signals. As only passive tags are required, the price for this system is shifted from the tags to the TAINS units. In other words, there is no need for active RFID tags which are much more expensive than passive tags. The upgrade in power and receptivity is produced from one antenna and several TAINS units as opposed to an increase in power for millions of RFID tags. The commercial case is obvious.

This system is contemplated for use in suburban environments or in geographical areas where cellular telephone service is poor. For example, the sensitive electronics in the outside antenna can transmit and receive for a distance of fifty miles. This invention is also designed for effective use in a cellular system which is constructed of large cell zones. It is also designed for use in a high density urban environment through use of a specifically designed 0 dB gain antenna which radiates more energy higher in the vertical plane to reach radio communication sites that are located in higher places. These systems are more useful in metropolitan areas with tall buildings. Alternatively, a 5 dB gain antenna radiates more energy toward the horizon compared to the 0 dB and can reach radio communication sites that are further apart and less obstructed. This is for use in deserts, plains, flat lands, and open farm or rural areas. A 3 dB gain antenna is the compromise in suburban and general settings.

The external antenna piece of this inventive system is also contemplated for use in environments where microwave signals are partially or completely blocked by the construction materials of the walls or roof of the environment or are disrupted by the materials within the environment.

The antenna design is of the directional type. As wireless devices have continued to move to higher and higher frequencies, antennas have gotten smaller. As cell towers transmit in the high UHF and low microwave frequency region the antenna is only a few inches long. In order to fit inside a cell phone they have been designed to fit within the PC board copper. Separate antennas optimized for best performance can be used. A popular antenna is the planar inverted F antenna. It works well but it is subject to loading by surrounding objects. Any devices near the antenna like discrete components or camera modules tend to couple to the antenna and absorb some of the radiated power making the antenna less efficient. Another problem is the loading of the antenna by the user's hand. Therefore, holding a hand held RFID interrogator couples the energy to the hand and detunes the antenna. This reduces efficiency and read rate. This is known as the excessive specific absorption rate (SAR). This rate measures the amount of RF which is coupled into a person's body. This coupling has the effect of reducing the received signal strength and decreasing the amount of radiated signal. This coupling effect in a normal RFID system would result in less coverage and more missed reads of RFID tags. In some systems this phenomenon is compensated for by increasing the power radiated. However, this shortens battery life in interrogators, increases power bills and can cause annoying interference with RFID systems of contiguous neighbors. In data transmission situations, diminished signal strength translates to reduced data rates. The answer proffered by this invention is an external directional antenna.

This invention is in response to a number of RFID industry challenges.

First, there is the challenge of waking up the passive RFID transponder. In order for a passive transponder to reflect or backscatter a radio signal to the interrogator it must first gather enough energy from the signal of the interrogator in order to reach an excitation level of roughly 1.2 volts. This is the threshold energy required to arouse the integrated circuit contained within the RFID transponder. As this invention contemplates a microwave remote interrogation it is clear to the inventor that operation in either the 2.45 MHz or 5.8 MHz bands will have problems in terms of reflections, refractions or absorption from metal and concrete surfaces located in the building materials of the outside perimeter of the environment. Normally, passive transponders struggle to operate around metal and are sensitive to the dielectric constant of the metal. Furthermore, shelving and environmental materials, such as metals or liquids, can reduce the amount of electromagnetic energy which is effectively transmitted to the RFID passive tag from the interrogating source. The result may be that the transponder harvests insufficient energy from the interrogation process to sufficiently awaken itself as instructed by the interrogation prompt. This invention addresses this RFID industry problem by using a TAINS unit to re-radiate a consistent strength interrogation signal at a much lower frequency than the initial microwave inquiry yet congruent to the resonant frequency of the RFID passive transponders.

Second, there is the challenge of insufficient energy to backscatter or reflect the energy of the initial interrogator. As in the paragraph above, the identical energy problems are evident to the inventor. Specifically, the electromagnetic signal quality must be of high enough power to overcome the obstacles posed by environmental problems, such as reflection or refraction by metals, concrete and liquids. Furthermore, there is an inherent compromise in the design of passive transponders. They must have the ability to both collect and backscatter a signal. This is a tradeoff which can result in a low power transmission meaning far less than 100% interrogation rates. In other words, the result is often a low signal to noise ratio. The solution, as presented by the inventor, is to provide a consistent power level at the resonant frequency of the RFID passive transponder. This is accomplished by the TAINS units whereby the inquiring electro magnetic signal is modulated and then re-radiated.

Third, the microwave transmission requires an external antenna to gather, harvest and capture electromagnetic signals in a metal, concrete and/or liquid intensive environment. The high frequency microwaves can carry a great deal of electromagnetic energy. This energy can travel very quickly. However, microwaves have the tendency to bounce off of metal and to be absorbed into concrete and liquid. Thus microwave remote RIFD inquiries become dissipated and ineffective. In response the inventor proposes an external antenna comprised of aluminum shavings/fibers and ceramic powders contained in a composite construction. Furthermore, this invention contemplates channel specific or channel cut external antenna construction for the circumstance whereby the strongest external cellular telephone transmission is constant. Alternatively, this invention contemplate the use of an electric motor and off the shelf direction finding electronics to shift the direction of the external antenna to face the strongest point of remote transmission at any given time.

PRIOR ART

The Micron patent by O'Toole of Jan. 30, 2007, U.S. Pat. No. 7,170,867, is the state of the art in terms of an RFID device. It contemplates an integrated circuit tag which includes a receiver, a transmitter, and a microprocessor. This is an active transponder design which was invented for the purpose of increasing the range and power of the electro magnetic signal emanating from the active transponder.

This can be distinguished from the current invention in that the Micron invention contemplates solving the problem of low read rates by increasing power at the level of the tag. The result is a more expensive tag. The present invention contemplates solving the problem of low read rates by increasing power in RFID system items external to the tag, such as the antenna and the interrogator. As there is one antenna and a handful of TAINS units contemplated in this invention, an upgrade on the interrogation side is far more cost efficient than increasing the power to hundreds of thousands or millions of RFID transponders.

The Charych U.S. Pat. No. 7,142,120 of Nov. 28, 2006, contemplates the use of a directional antenna in an RFID infrastructure. This invention is for the purpose of limiting the beam pattern of the interrogator so that bearing angle data can be harvested. The function is item location within an RFID interrogation zone.

This can be distinguished form the current invention in that the Charych invention contemplates a system to pinpoint the location of an item within the field of view of an RFID interrogator. The present invention contemplates the use of a directional antenna whose function is to harvest electro magnetic signals from a remote interrogation source such as a microwave inquiry from a cellular telephone transmission tower. In other words, the directional antenna in the Charych invention is intra environment while the present invention uses a directional antenna external to the environment.

There is a patent by Feher, U.S. Pat. No. 7,133,471, dated Nov. 7, 2006, which contemplates the demodulation of multiple signals. This can be distinguished from the present invention which contemplates modulation and re-radiation by a TAINS unit for the purpose of blanket coverage of the environment in the frequency resonant to the RFID tags located therein.

There is a study by Kim and Ko titled "A Directional Antenna based Path Optimization Scheme for Wireless Ad Hoc Networks" which advocates the use of directional antennas in wireless ad hoc networks due to potential advantages such as low power consumption and low chance of interference. In order to maximize these advantages the authors advocate a routing scheme called Directional Antenna based Path Optimization which is a protocol to receive an efficient path by considering the characteristics of directional antennas.

This study can be distinguished from the present invention in that the present invention contemplates nothing more complex than a direction finding mechanism attached to the antenna which aids in pointing the directional antenna towards the strongest cellular telephone transmission tower signal. However, this study does reiterate the utility of directional antennas for the purpose of reducing interference and lowering power consumption.

There is a study by Hu and Evans titled, "Using Directional Antennas to Prevent Wormhole Attacks", which obviates the problem of hackers of a wireless system by using directional antennas to prevent wormhole endpoints from masquerading as false neighbors.

This study reiterates another utility for the use of an external directional antenna in an RFID system; specifically, the security of the data being transmitted back to the initial inquiry by the cellular telephone transmission tower. However, the study does not contemplate the use of directional antennas in an RFID system which is the bearing post of the present invention.

BRIEF DESCRIPTION OF THE DRAWINGS

FIGS. 1A and 1B (Appendix A) is a schematic illustration of the capture by an antenna external to a warehouse or distribution center of a microwave or ultra high frequency cell phone initiated interrogation signal designed to elicit information from RFID transponder tagged items within the warehouse or distribution center.

FIGS. 2A and 2B (Appendix B) is a schematic illustration in the remote interrogation showing, within the warehouse center, the transformation of the signal captured by the external antenna into RFID transponder resonant frequency, its modulation and re radiation throughout the warehouse, transponder interrogation and a return of the signal transformed into microwave or ultra high frequency for transmission, through the external antenna, for capture by cell phone tower.

SUMMARY OF THE INVENTION

Electro magnetic signals are created through the movement of electrical charges in antennas. As the signals are created, waves of electro magnetic energy radiates away from the antenna. All electromagnetic waves travel at the speed of light. The major differences between the different types of waves are the distances covered by one cycle of the wave and the number of waves that pass a certain point during a set time period. The wavelength is the distance covered by one cycle of a wave. The frequency is the number of waves passing a given point in one second. For any electromagnetic wave, the wavelength multiplied by the frequency equals the speed of light.

This information is important in the design of an antenna as the antenna only works if it is resonant with the transmitting frequency. In other words, the physical characteristics of the antenna must mimic the wave length of the transmitting signal in order to resonate. For example, the wavelength of a transmission can only be effectively captured or harvested by an antenna if it is an even multiple or fraction of the wavelength of the transmitted electro magnetic signal. Quarter wavelengths are common. In other words, the antenna must be the same in size, or multiple or fraction thereof, of the electro magnetic wave it is attempting to capture. The specific size causes the electrical wave to be felt stronger by the antenna for a specific frequency. This is resonance.

In order to transmit cellular telephone signals fixed antennas are used for transmission. These are called base stations and consist of antennas and electronic equipment. The antennas need to be high in the air and are often located on towers, poles, water tanks, or rooftops. Typical heights for freestanding base station towers are in the 50-200 foot range. For base stations in rural areas antennas that look like poles, 10 to 15 feet in length. These cellular telephone transmission towers utilize omni directional antennas. In suburban and urban areas these are reduced to panel or sector antennas consisting of rectangular panels about one to four feet in dimension.

This invention contemplates a directional composite antenna installed on the rooftop of the environment to maximize coverage and signal strength. The use of any type of antenna does not change the fact that RF radio frequency signals get weaker as the distance traveled increases. This is a phenomenon known as attenuation. However, the present invention contemplates expanding the power of reception and transmission over distance through the use of a composite directional antenna.

A problem with the ubiquitous omni directional antennas is that two omni directional antennas will cause cell tower transmission jamming. One remedy is to put a lead wall between the two antennas or, alternatively, to remove one. The two omni directional antennas in close proximity create a hideous subsonic screech.

The other remedy is to design a directional outdoor composite antenna which is pointed in the direction of the cellular telephone transmission tower. There are commercial gadgets available which assist in direction finding in order to properly align the directional antenna. As the microwave inquiry signal is received by the outside antenna from the cellular telephone transmission tower base station it is trite that the directional antenna should be pointed in the direction of the cellular telephone transmission tower.

Once the initial inquiring signal is captured and harvested this signal is amplified and repeated within the environment through TAINS units located on the ceiling of the environment. The TAINS units are installed in a configuration to give exhaustive full power coverage to the entire environment. The process is reversed when the backscatter data is received from within the environment. This backscatter information and data is amplified, modulated to the frequency of the initial microwave frequency and transmitted to the originating cellular telephone transmission tower.

Pursuant to this invention the external antenna must be a specified distance from the internal ceiling TAINS units. This is because if this distance is not maintained the electro magnetic signal will oscillate between the two antennas resulting in no improvement in RFID tag read rate. For example, the actual distance and not cable length between the external and internal TAINS units must by 45 feet for a 50 dB system and 75 feet for a 60 dB system. These distances can be reduced by 30% if the roof is constructed of metal or concrete.

The amplifier within the TAINS units contains power control logic to ensure the maximum output power of 2 watts is never exceeded.

The external antenna is constructed of a composite of aluminum and ceramics to increase directional gain. The radiation of the external antenna is directional. The external antenna boom is constructed of aluminum and is treated with a commercially available substance which anodizes the clamps and protects the elements from ultra violet and weather related damage.

The external antenna can be channel cut at the factory if a consistent direction is known for the strongest cellular telephone transmission tower. Alternatively, the external antenna can be connected to an electric motor attached to the boom which changes the direction of the directional antenna. This shifting direction can be monitored by commercially available gadgets and the shift can be automatic as the cell system switches from one tower to another.

The useful, non-obvious and novel steps contained in the present invention are:

1.) A system to capture the remote interrogation of an environment from a cellular telephone transmission tower through the use of an external composite aluminum and ceramic directional antenna.

2.) A method of changing the direction of the external antenna through the use of an electric motor attached to the boom of the antenna and commercially available direction finding equipment or cutting the external antenna to a known direction.

3.) A method of modulating and re-radiating the initial remote inquiry for the purpose of exhaustive and consistent RFID interrogation coverage within the environment through the use of TAINS units.

The embodiments of the invention in which an exclusive property or privilege is claimed are defined as follows; and what is claimed is:

1. A Radio Frequency Identification system (RFID) to capture a remote microwave frequency or ultra high frequency interrogation of RFID transponders attached to articles in a warehouse or distribution center environment through a microwave or ultra high frequency RFID inquiry emanating from a cellular phone transmission tower wherein said system comprises:

A directional external yagi antenna affixed to the exterior of the distribution center or warehouse distribution center; and said external yagi antenna further being channel cut to correspond precisely to a remote electromagnetic signal direction and frequency; an electric motor attached to a boom of the external yagi antenna to enable the antenna to change direction; a directional finding equipment spliced to the circuit of the external yagi antenna so that the pointing direction of the antenna is shifted to the cellular telephone transmission tower of a cellular telephone transmission cell division which is currently handling data transmission in relationship to the antenna; multiple transformers, the antenna and interrogation units mounted to a ceiling of the warehouse or distribution center to modulate and reradiate signals of the remote microwave or ultra high frequency interrogation to interrogate transponders attached to articles at the articles' resonant frequency and re-radiate responses to the external yagi antenna for capture by the cellular transmission tower; said multiple transformers, antenna and interrogator units being powered by wall sockets and connected electronically to the external yagi antenna; the transponders attached to the articles stored within the interior environment of the warehouse or distribution center.

2. The system of claim 1 whereby further the yagi external antenna is constructed of a composite formula of aluminum shavings and ceramic powders to amplify the electro magnetic signals radiated from a cellular telephone transmission tower for the purpose of enhancing RFID interrogation of a warehouse or distribution center environment.

3. The system of claim 1 whereby further aluminum shavings and ceramic powders are mixed into slurry and baked onto the yagi external antenna for the purposes of increasing the sensitivity of the antenna to electromagnetic radiation.

4. A Radio Frequency Identification system (RFID) to capture a remote microwave frequency or ultra high frequency interrogation of RFID transponders attached to articles in a warehouse or distribution center environment through a microwave or ultra high frequency RFID inquiry emanating from a cellular phone transmission tower wherein said system comprises:

A directional external yagi antenna affixed to the exterior of the distribution center or warehouse distribution center; and said external yagi antenna further being channel cut to correspond precisely to a remote electromagnetic signal direction and frequency; an electric motor attached to a boom of the external yagi antenna to enable the antenna to change direction; whereby further the yagi external antenna is constructed of a composite formula of aluminum shavings and ceramic powders to amplify the electro magnetic signals radiated from a cellular telephone transmission tower for a purpose of enhancing RFID interrogation of the warehouse or distribution center environment; and whereby still further aluminum shavings and ceramic powders are mixed into slurry and baked onto the yagi external antenna for purposes of increasing the sensitivity of the antenna to electromagnetic radiation; a directional finding equipment spliced to the circuit of the external yagi antenna so that the pointing direction of the antenna is shifted to the cellular telephone transmission tower of a cellular telephone transmission cell division which is currently handling data transmission in relationship to the antenna; multiple transformers, the antenna and interrogation units mounted to a ceiling of the warehouse or distribution center to modulate and reradiate signals of the remote microwave or ultra high frequency interrogation to interrogate transponders attached to articles at the articles' resonant frequency and re-radiate responses to the external yagi antenna for capture by the cellular transmission tower; said multiple transformers, antenna and interrogator units being powered by wall sockets and connected electronically to the external yagi antenna; the transponders attached to the articles stored within the interior environment of the warehouse or distribution center.

* * * * *